US008002501B2

(12) United States Patent
Dos Santos et al.

(10) Patent No.: US 8,002,501 B2
(45) Date of Patent: Aug. 23, 2011

(54) OUTER DEVICE FOR UNIVERSAL INSPECTION OF RISERS

(75) Inventors: Melquisedec Francisco Dos Santos, Rio de Janeiro (BR); Luciano Luporini Menegaldo, Rio de Janeiro (BR); Mauricio De Oliveira Brito, Rio de Janeiro (BR)

(73) Assignees: Instituto Militar De Engenharia—IME, Rio de Janeiro (BR); Inspectronics Engenharia e Consultoria LTDA, Rio de Janeiro (BR)

( * ) Notice: Subject to any disclaimer, the term of this patent is extended or adjusted under 35 U.S.C. 154(b) by 466 days.

(21) Appl. No.: 12/151,148

(22) Filed: May 1, 2008

(65) Prior Publication Data

US 2008/0313915 A1 Dec. 25, 2008

(30) Foreign Application Priority Data

Jun. 19, 2007 (BR) ..... 0705113

(51) Int. Cl.
*E02D 5/60* (2006.01)

(52) U.S. Cl. ..... 405/211; 405/211.1; 405/216

(58) Field of Classification Search ..... 405/211, 405/211.1, 216, 223.1, 224, 224.2, 224.3, 405/224.4; 166/367, 350
See application file for complete search history.

(56) References Cited

U.S. PATENT DOCUMENTS

| | | | | |
|---|---|---|---|---|
| 6,371,696 | B1 * | 4/2002 | Eathorne | 405/211 |
| 2009/0217946 | A1 * | 9/2009 | Anthony | 134/18 |
| 2009/0217954 | A1 * | 9/2009 | Hall | 134/115 R |
| 2010/0163239 | A1 * | 7/2010 | Angel et al. | 166/311 |

FOREIGN PATENT DOCUMENTS

BR 200605010 A * 7/2008

* cited by examiner

*Primary Examiner* — Frederick L Lagman
(74) *Attorney, Agent, or Firm* — TraskBritt

(57) ABSTRACT

This invention refers to a device that has a direct applicability in the oil industry, detecting on a prevention basis, failures that may be externally visualized on the walls of the risers. Externally coupled to a pipe in free catenary, called riser, the device involves such a pipe in its entire perimeter and allows for the making of non-destructive inspections of several natures concurrently, while the device moves along all its extension. The device moves along the riser downwards and upwards by a combination of gravity, buoyancy, thrusters and action of expansion of gases.

13 Claims, 3 Drawing Sheets

OUTER DEVICE FOR UNIVERSAL INSPECTION OF RISERS

CROSS-REFERENCE TO RELATED APPLICATION

This application claims the benefit of the filing date of Brazilian Patent Application Serial No. PI 0705113-1, filed Jun. 19, 2007.

TECHNICAL FIELD

This invention refers to a device that is coupled externally to a pipe in free catenary (riser) involves the pipe on its overall perimeter, which allows inspections of several kinds, while it moves along its entire longitudinal extension. Such a device moves along the riser by the combination of the force of gravity, thrust, traction of the servo-engines or due to the action of expanding gases.

The device has a direct applicability in the oil industry, preventively detecting failures externally visualized on the riser walls, and concurrently other kinds of miscellaneous inspections may be accomplished, as from the outer walls of the riser, such as, for instance, ultrasound inspection, remote field inspection, MFL and ACFM.

BACKGROUND

In offshore oil production, one utilizes a set of pipes that flows out the production of a productive well on the bed of the sea towards a platform that is located on the surface of the sea and the aforementioned set of pipes control valves and pumps located on the well-heads. This set of pipes (electrohydraulic, umbilical lines, injection of water and pumping of oil and gas properly spoken) is on a conventional basis, denominated production line.

This set of pipes that make up the production lines are basically subdivided into three different portions:

The first portion, the major part of which is horizontal and is laid on the seabed, is made up by a piping that may be either stiff or flexible, that connects the oil well to a point that stands under the location of the platform, and which is called horizontal section-of-pipe for collecting purposes. This section-of-pipe is known in the technical jargon as flow.

The second portion is a bended-shaped and suspended section-of-pipe that connects the piping that is essentially horizontal and stands on the seabed, with a third section-of-pipe that is mostly vertical. This section-of-pipe, which is typically curve-shaped and suspended, may have the configuration of a free catenary, comes to show configurations known as lazy-wave or steep-wave.

And the third portion is made up by a section-of-pipe that is mostly vertical and contiguous to the formerly mentioned piping, goes upwards until the surface, being denominated vertical section-of-pipe for collection purposes.

The set-of-pipes composed of the bended-shaped section followed by the mostly vertical portion is called riser in the technical jargon, and shall be treated conventionally as from this text as production collection line.

The production collection lines may either be stiff or flexible and can be deemed to be the most critical structures of a system of production in the sea (offshore).

These production lines usually undergo operational wear, such as the action of the outer and inner pressure, the inner-side friction between the several layers that constitute it, the presence of corrosion, fatigue, in addition to undergoing incessant action derived from the dynamic and variable conditions related to the environment. The production collection lines are also submitted to the influence of the large-sized movements resulting from the floatability of the platform, the aforementioned movements taking place both in the horizontal and the vertical senses, on account of the tides, the sea currents, and the waves.

In summary, a production collection line may be undergoing several mechanical loads, such as axial traction applied on its higher end that is located on the platform; the very weight of the structure; in some cases, the thrust load on the liner; first- and second-order movements caused by the movements of the platform; the load that is derived from the waves; dragging force stemming from the sea currents and other hydrodynamic forces, like the one that takes place on account of vorticity; cyclical loadings that induce fatigue into the structure; and corrosion-connected effects caused both by the environment and the innerside fluid.

On the other side, when the production collection line is submitted to large-sized deflections, such as buckling, that takes place in the bended-shaped section-of-pipe of the catenary located next to the sea ground, its outer wall may show wrinkles (in the case of the fine wall thicknesses) or indentations (in the case of average to thick wall thicknesses). In the flexible-type production collection lines, the phenomenon of buckling may cause a defect known as "bird cage" in the steel wires that make them up.

As a highlight, one shall give attention to the hydrodynamic force that is derived from the known effect of loosening of vortices originating from the action of sea currents around the outer surface of the production collection line. The vibrations that are induced by vortices give origin to low-amplitude and high-frequency, which are transversal to the sense of the sea currents called "VIV" (Vortex Induced Vibrations). These loads may lead to a precocious fatigue process that, in its turn, may bring about the collapse of the pipe, causing a disaster of environmental nature and a high operational loss.

For these reasons, the production collection line is a critical element to the continuity of production and also for the safety of the environment. Because this one element is subject to the most diverse efforts that may simultaneously affect its structure, it is necessary that the whole production collection line be submitted to a stringent regular inspection.

There are currently some means with which it is possible to carry out these inspections. The main items verified in relation to the outer condition are the level of wearing of the cathodic production system, the existence of crackles or kneading and incrustrations, among others.

The exam of the structure is carried out through ultrasound, techniques based on induced magnetic fields, and visual exams. One also utilizes other kinds of Non-Destructive Testing (NDT), but each exam is performed by means of a specific procedure and specific pieces of equipment.

Most of these analyses are made at present by utilizing the PIGs (Pipe Inspection Gauge), which are introduced into the innerside of the production collection line and move along the section-of-pipe where one wants to carry out the inspection. Such gauges could be inserted to move forward by the production fluid itself. Each PIG is fitted with a specific inspection piece of equipment for the reading of ultrasound or any kind of other equipment that enables one to make analyses from the innerside of the production collection line.

In order to make inspections by means of this tool, it is necessary to order the stoppage of the production of the branch for the introduction of the PIG. The production of this branch is reduced to the minimum, or is even paralyzed, until the end of the inspection. As the time of stoppage is directly related to the speed of dislocation of the tool into the innerside of the pipe, which is around 1 km/h, one would suppose that a pipe measuring 20 km would require a stoppage of at least 20 hours, only in one sense of the dislocation of the tool.

In addition to limiting the inspection to the type of equipment that one supplies to it in order to carry out the analyses, the PIG does not perform an outer visual inspection of the structure of the production collection line.

The outer visual inspection is especially relevant when the structure of the production collection line is of the flexible type, because damage to the outer cover exposes to the severe environmental conditions the metallic wires that vest upon it a structural resistance.

Damages to the outer cover may be caused from abrasion, fall of platform-originated material onto the production collection line, and from growth of sea life on the outer cover.

At present, the outer visual inspection of the production collection lines is made by Remotely Operated Vehicle (ROVs). In addition to being a costly operation, the technician that operates the equipment must take extreme care in maneuvering the vehicle so as to circulate the perimeter of the production collection line along its whole length in order to ensure the analysis of the entire external surface of the structure, mainly the portion of the catenary that is subject to buckling and, therefore, is critical in relation to fatigue and cracklings.

Another parameter that needs to be monitored is the influence of the hydrodynamic force derived from the loosening of vortices, stemming from the action of the sea currents around the outer surface of the production collection line. Because it is a critical parameter that may accelerate fatigue, there must be a collection of data from the greatest number of points along the production collection line.

These data are currently collected by fitting the production collection line with bottles of Vortex Induced Vibration (VIV), that are accelerometers assembled in the innerside of metallic cylinders. These VIV-bottles are fixed on the production collection lines during their installation, or at any time by means of a ROV.

Because of the unitary cost of each bottle of VIV and because of the installation cost, only a certain number of these bottles is set up on the production collection line so that they may supply data from some representative points of the umbilical structure. The sets of information are stored into the internal memory of the bottles for a certain period of time. Later on, the VIV bottles are collected by ROV for the analysis of the data recorded therein.

When one wishes to have a greater number of data on the VIV, one also makes use of simulations performed in large-sized closed laboratories, where segments of production collection lines are exposed to currents of fluids that can be induced under control. This method, despite of furnishing the software of analyses with valuable data, does not supply real data in real time.

Taking into consideration what was presented hereinbefore, in terms of the techniques currently known for the inspection of production collection lines, there is no piece of equipment that allows for the making of ultrasound inspections or other non-destructive testing concurrently with the making of external visual inspection and that, in addition thereto, make it possible for one to collect data from VIV.

The inspections made by PIG do not allow for an outer visual inspection, and the collection of data originated from VIV is made in a certain number of fixed points. There is no piece of equipment that permits in loco to choose and to vary the points wherein one wishes to make the collection of VIV data on the production collection line and that supplies the data in real time for the purposes of analysis.

In order to overcome these problems of regular verification of the state of the production collection line, avoiding stoppages in the production and reducing the number of procedures and pieces of equipment involved, one has conceived an outer set of devices, the purpose of which is the universal inspection of risers.

The invention described hereunder is derived from the continuous research in this segment, the focus of which aims at eliminating the necessity of using PIGs, and also ROVs, so as to unify the various procedures into one single operation.

This invention is aimed at furnishing a device that may be utilized in any production collection line, reaching any depth at which one wishes to make an inspection, such a device being fitted with means of carrying out visual inspections that are concurrent with Non-Destructive Testing (NDT), and moreover to associate means of collecting data from the VIV at any point of the structure.

Other aims that the outer device for universal inspection of risers proposes to reach, which is the purpose of this invention, are listed hereunder:

(a) To eliminate the necessity of utilizing ROVs for the visual inspection, reducing both the cost and the time factors;
(b) To enable a visual inspection with a three-dimensional image;
(c) To eliminate the need of utilizing bottles of VIV in order to collect data from the operation of accelerometry, and as a consequence, the utilization of ROVs in the fixation of the bottles;
(d) To eliminate the necessity for PIGs in order to make NDTs;
(e) To ensure, in real time or offline, the reading of the data and of the images captured;
(f) Allow for the choice of the points from where one wants to record data for VIV;
(g) To allow for the making of NDTs without the need to interrupt production;
(h) To increase the efficiency of the inspection in the section-of-pipe of the catenary;
(i) To allow for the operations of cleaning of the outer wall of the production collection line; and
(j) To allow for X-ray analyses.

DISCLOSURE OF INVENTION

This invention refers to a device that moves along the external wall of a production collection line, so as to perform visual inspections concurrently with non-destructive inspections of other kinds.

The device is made up by two ring-shaped underframes distanced from one another and parallel between them, interconnected by at least three beams that be equidistant from one another and standing in parallel to the axis of a production collection line. Both the upper ring-shaped underframe and the lower ring-shaped underframe present a rectangular, parallelepedic-shaped profile and are made up by two semicircular sections united by hinges, and a means for closing purposes.

The upper ring-shaped underframe is fitted on its internal face with a trail with the profile shaped as a "T" that in turn is fitted with an engine-driven trestle whereupon one shall assemble the various sensors of equipment for non-destructive testing.

On its turn, the lower ring-shaped underframe is fitted with two stopping devices of a semicircular shape that constitute a device for the control of speed.

The beams that interconnect and keep the ring-shaped underframes parallel, both the upper and the lower ones, are fitted with arms standing orthogonally to the main axis of the device, both beams being designed in an upwards sense, so that its free end is located in a point that is distant from the outer surface of the production collection, the upper beam being located at the level of the upper ring-shaped underframe. The free ends of these arms are provided with cameras with their foci directed to the outer surface of the production collection line.

Externally to the outer alignment of the ring-shaped underframes and fixed to these by means of support, are provided at least three hermetic cameras that are equidistant among themselves, with a mostly cylindrical shape and standing in parallel to the axis of the device. These three cameras are the receptacles utilized in order to house at least three indispensable systems for the perfect running of the invention, these systems being the communication system, the inspection system, and the power/movement system.

In the inner portion of the outer device for universal inspection of risers are fixed at least four sets of equidistant supports provided with rollers.

BRIEF DESCRIPTION OF THE DRAWINGS

The invention shall be described more in detail hereunder, along with the drawings that are listed below, such drawings being for the sole purpose of example, following this report of which they are an integrant part, and in which.

DETAILED DESCRIPTION OF THE INVENTION

The outer device for universal inspection of risers, which is the purpose of this invention, was developed based upon a set of research, the aim of which was to unify standardized procedures of non-destructive inspections of a production collection line for an auxiliary external visual inspection, therefore supplying a more efficient inspection at a lower cost. By needing less equipment and a smaller number of technicians, and upon no need for the reduction or the stopping of the production, the outer device for universal inspection of risers, the purpose of this invention, makes room for both making inspections more frequent and for procedures for preventive maintenance, such as the cleaning of the outer surface of the production collection line.

In this sense, the research was devoted initially to the development of a device that would be capable of giving an outer image of the production collection line associated with information generated by NDT sensors that are traditionally provided with internal inspection equipment, such as the PIGs.

Figure 1:
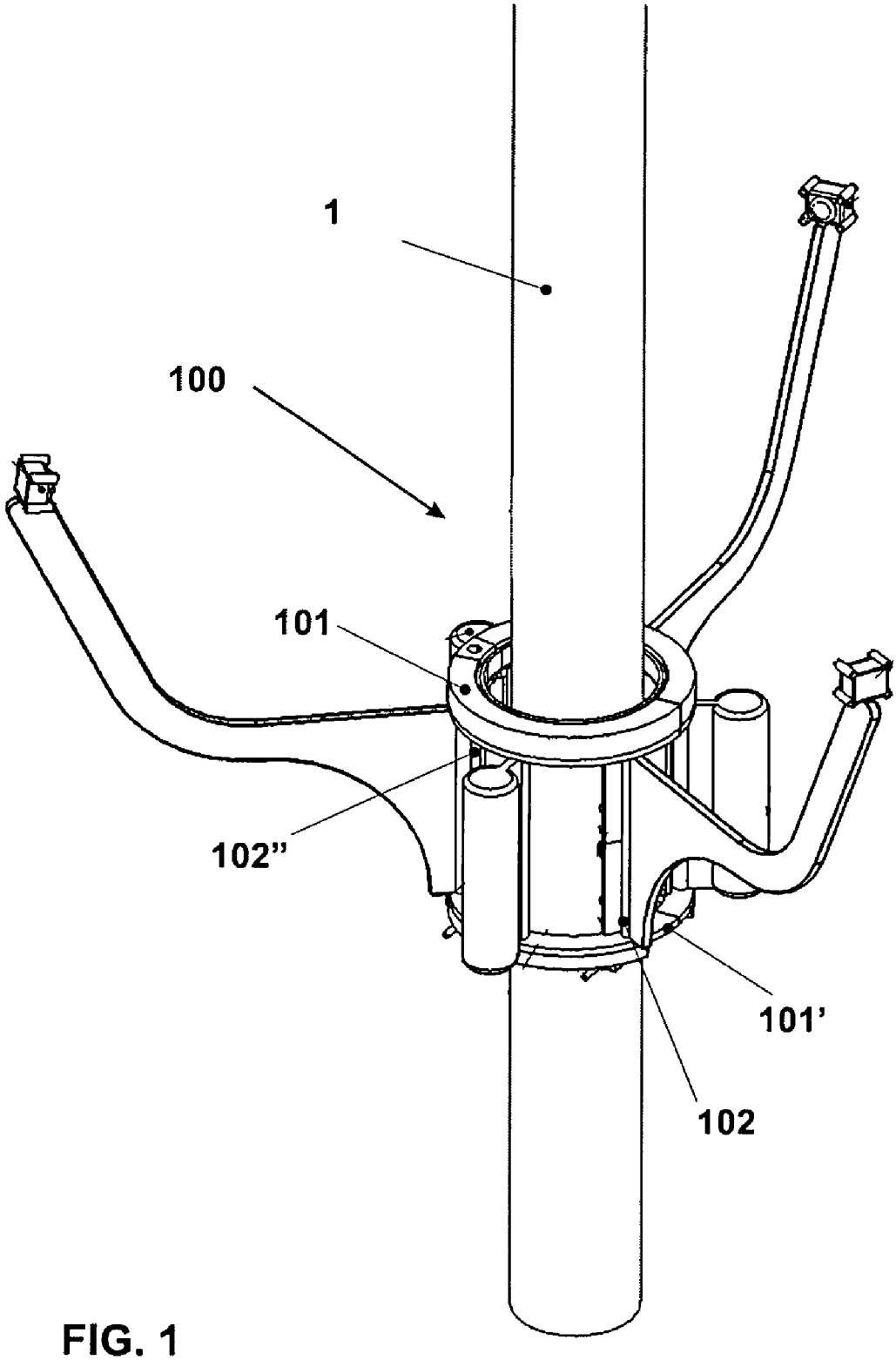
FIG. 1 shows a panoramic view of the device that is the purpose hereof, such a view being applied in a production collection line.

Referring to FIG. 1, it is possible to verify and to better understand how the outer device for universal inspection of risers (100) performs on the production collection line (1), embracing it so as to make its vertical axis coincide with the axis of the production collection line (1).

As it may be easily visualized, the external device for universal inspection of risers (100) could, in short, be described as a main circular body provided with rollers for moving, means for speed control, sensors for the making of the inspections and at least three water-tight compartments for the transportation of electro-electronic components.

The external device for universal inspection of risers (1) is made up by two ring-shaped underframes (101) and (101') distant and parallel between them, interconnected by at least three beams (102), (102') and (102") having the same distance between themselves and parallel to the axis of the production collection line.

Figure 2:
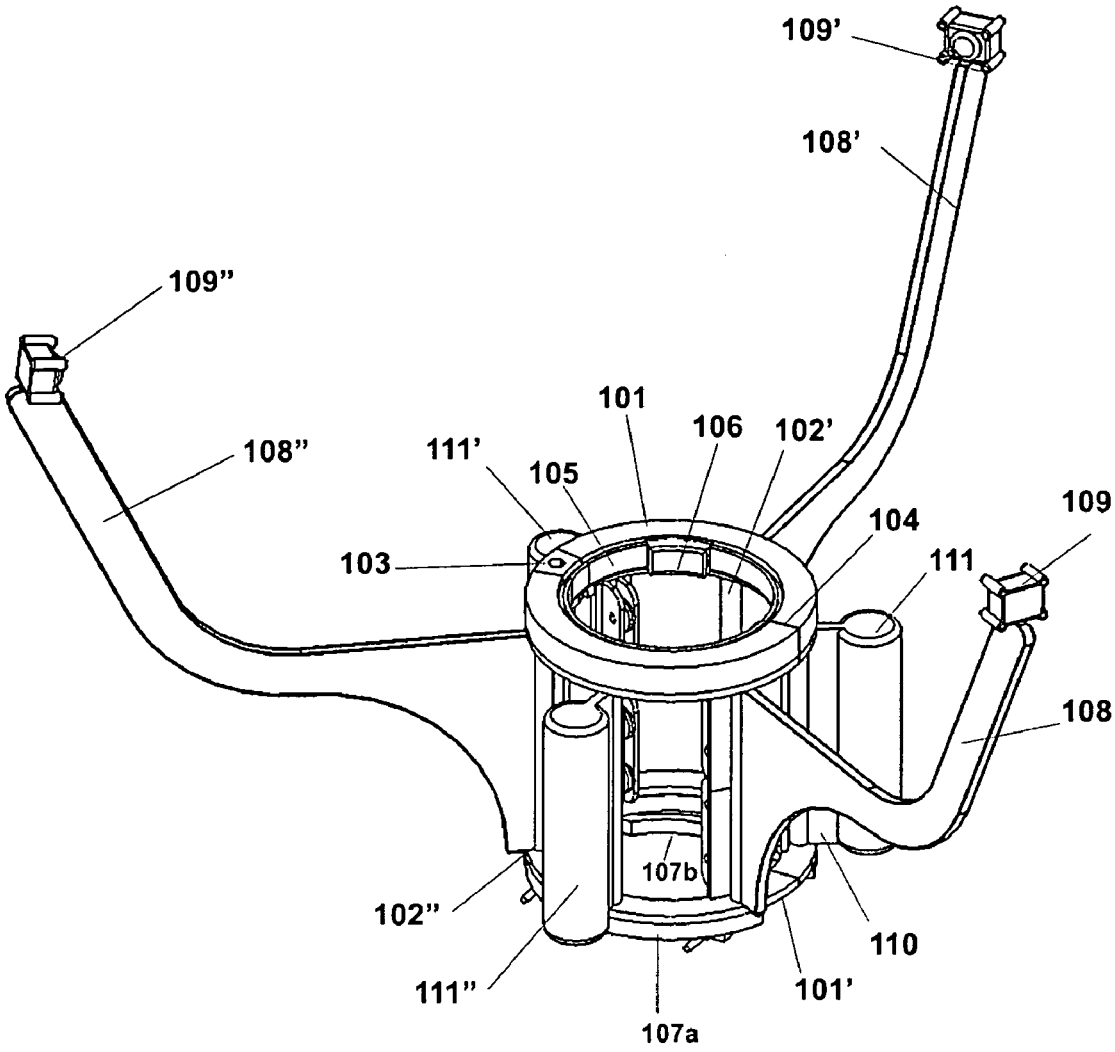
FIG. 2 shows a panoramic view of the device that is the purpose hereof.

FIG. 2 allows for a better visualization of the components of the outer device for universal inspection of risers (100).

Both the upper ring-shaped underframe (101) and the lower ring-shaped underframe (101') present a rectangular parallelepedic profile and are made of two semicircular sections united by hinges, respectively (103) and (103') and a means of closing (104) and (104'), the latter being preferably of the quick-coupling type.

The upper ring-shaped underframe (101) is also provided for in its internal face, by a track (105) with a "T"-shaped profile. The track (105) on its turn is provided with a motorized trestle (106) upon which one shall fix the various sensors of equipment for non-destructive testing.

The motorized trestle (106) may be driven by means of a remote signal so as to start a movement of translation by means of the track (105), performing successive rotations around the main axis of the outer device for universal inspection of risers (100), while such a device makes a sliding movement on the external surface of the production collection line (1). Thus, any sensor fitted to the trestle (106) shall be capable of swaying the whole perimeter of the outer surface of a production collection line so as to collect data for the making of some type of non-destructive testing.

Optionally, on the same motorized trestle (108), one may fix a proper brush or any other type of tool for eventual operations of cleaning of the outer surface of a production collection line (1).

The lower ring-shaped underframe (101'), on its turn, is provided with a device of speed control (107), fitted with two interlocks (107*a*) and (107*b*), the shape of which is semicircular.

The beams (102), (102') and (102") that interconnect and keep parallel the upper and lower ring-shaped underframes (101) and (101'), bringing about the resistance to the main body of the outer device for universal inspection of risers (100), are fitted with arms (108), (108') and (108"), orthogonal as to the main axis of the device, and designed in an upward sense, so as to have its free extremity located in a point far from the external surface of the production collection line (1), and higher than the level of the upper ring-shaped underframe (101).

In the constructive configuration shown in FIG. 1, the arms (108), (108') and (108") show a bended, boomerang-like shape. The free extremities of these arms are fitted with cameras (109), (109') and (109") with their foci directed to the external surface of the operation collection line (1), which enables the generation of images in the visual spectrum, or others, for example, thermal images, depending upon the type of camera utilized. Furthermore, it is possible to utilize techniques of image processing and merger of data for the automated detection of failures.

The moving-away of the cameras in relation to the main axis of the device is enough for one to have, further to the unitary panoramic image, also by means of specific techniques, the generation of three-dimensional images of the outer surface of the production collection line (1), increasing the efficiency of the visual inspection.

Still externally to the outer alignment of the ring-shaped underframes (101) and (101'), and fixed to these by means of supports (110), (110') and (110"), the external device for universal inspection of risers (100) is fitted with at least three hermetic cameras (111), (111') and (111"), having the same distance between them, with a shape that is predominantly cylindrical and parallel to the axis of the device.

These cameras are the receptacles utilized to house at least three systems that are indispensable for the perfect functioning of the invention, which are:

1*) Communications system—a plate of communication (modem) that will receive and send to a base of operations the signals of control and performance of the microcontrollers and/or data collected by the analysis-related sensors. This communication may be made by cables or by means of acoustic sonar.

2*) Inspection system—made up by all the set of electronic components related to the cameras (109), (109') and (109") and to the other non-destructive inspection equipment that operate simultaneously with the cameras. Eventually, it may house the commands of some outer surface cleaning equipment of the production collection lines (1).

Some examples of non destructive testing equipment that may be shipped on-board are:

The ones related to ultrasound—sound waves are sent to an object and the reflex thereof may be evaluated for the obtention of data on the thickness and the existence of failures in the material.

Testing of Magnetic Flux Leakage (MFL), where a magnet is utilized in order to magnetize a metallic surface, with the purpose of detecting field disturbances in the areas where there is corrosion or where there is missing metal.

Eddy Currents Testing, wherein the object that is analyzed is submitted to an alternate magnetic field which, by its turn, generates eddy currents; in the case that there is a defect in the object, the pattern of the eddy currents undergoes an alteration indicating a failure in the object analyzed.

Alternating Current Field Measurement (ACFM) testing. This technique is capable of detecting and dimensioning cracks.

Pulsed Eddy Current (PEC) Testing, a new technique also based in the magnetic field, where one could analyze parameters of distance, electrical resistivity and thickness of the object under analysis.

Finally, one of these cameras can also be the receptacle of an accelerometer for the purposes of VIV-data collection.

3*) Power and Movement System—this system is responsible for the autonomy and management of the energy of the device, where one shall set-up batteries for the feeding of the on-board equipment, the illumination, speed control (107), and one module for coming-back to the surface.

The coming-back to the surface module, contained in one of the three hermetic cameras (111), (111') and (111"), permits the emptying of the compartments that were flooded with water and distributed by one or more cameras. The emptying is obtained by pyrolysis or expansion of compressed gases. Upon the emptying of the initially flooded compartments, the density of the outer device for universal inspection of risers (100) changes, and what takes place is the operation of contrariwise movement, going up until surfacing. The coming-back operation can be performed by means of thrusters.

Figure 3:
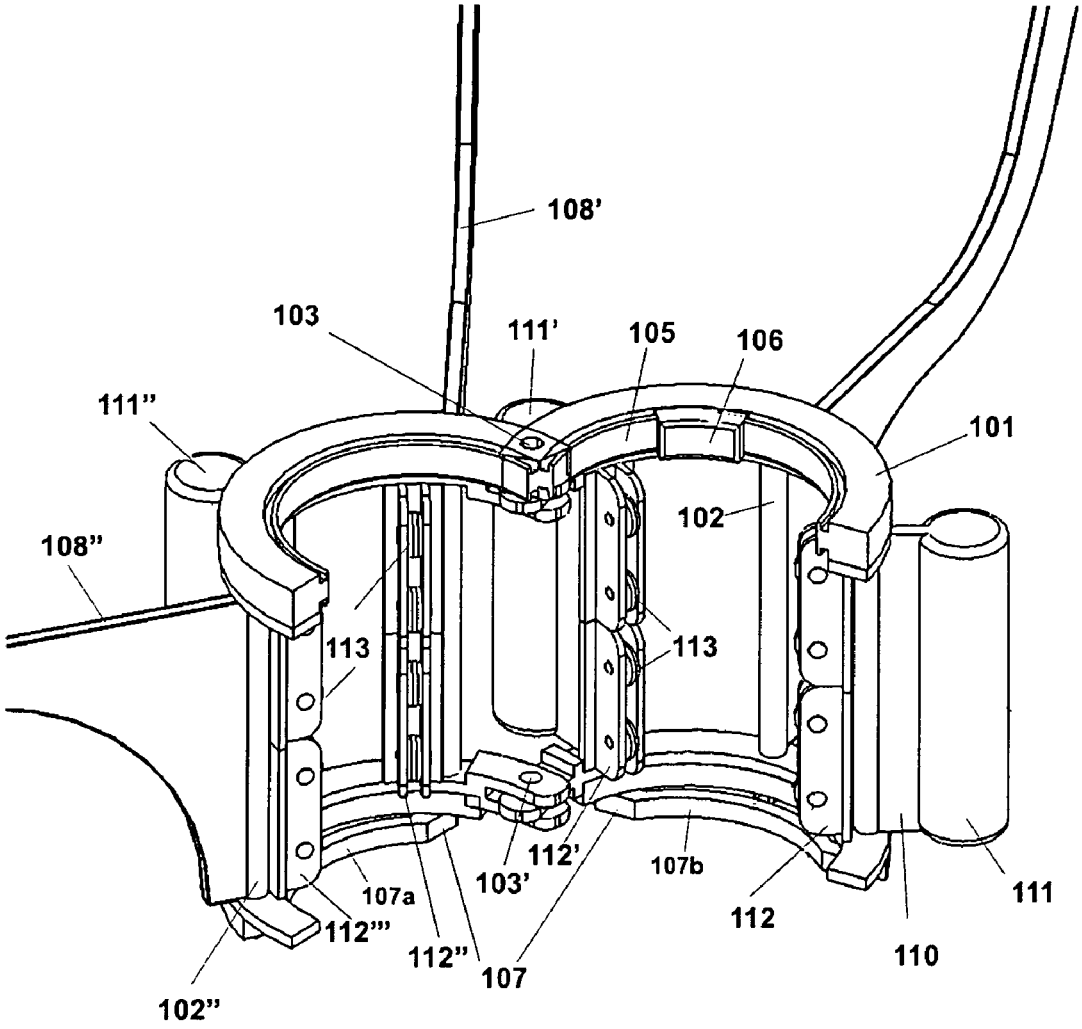
FIG. 3 shows the object of the invention in an open position, apt for the operation that leads to the coupling performance in a production collection line.

FIG. 3 shows an image of the outer device for universal inspection of risers (100) in an open view, and allows for a better visualization and understanding of some details of the device.

Referring to FIG. 3, it is possible to perceive the innerside of the outer device for universal inspection of risers (1), where one finds fitted at least four sets of equidistant supports (112), (112'), (112") and (112'''), fitted with rollers (113). These sets shall always be in contact with the external surface of the production collection line (1) so as to direct the going-down of the outer device for universal inspection of risers (100), since the surface up to the final portion of the catenary.

The supports (112), (112'), (112") and (112''') are provided with adjustment contrivances (not seen on the figure) of the device at any diameter of the production collection line (1) existing on the market, and that allow establishment with precision the alignment of the axis of the outer device for universal inspection of risers (100) with the axis of the production collection line (1), keeping a proper pressure for the free movement of the device along the whole length of the production collection line (1), with no critical locking or misalignment.

Optionally, some rollers (113) may be fitted with remotely driven motoring traction. This option is valid for environmental situations where there is high level sea currents to which the outer device for universal inspection of risers (100) may be submitted to. In these cases, the auxiliary motoring traction, in combination with the force of gravity or the thrust, shall serve to ensure the movement of the device.

By means of FIG. 3, it is possible to visualize the two interlocks (107*a*) and (107*b*), which have a semicircular shape, of the speed-control device (107), which may perform as much during the going-down operation as during the going-up operation of the device, bringing about friction against the surface of the production collection line (1) and, as a consequence, the stoppage of the movement in any of the senses.

It is also possible to visualize, in a greater degree of detail, the trail (105) with the "T"-shaped profile and the motor-driven trestle (106). The remotely activated trestle shall make successive circumferential movements on the extension of the trail (105), transporting some of the non-destructive testing sensors already mentioned earlier, or any other that could be utilized for the inspection of the structure of a production collection line (1).

It must be highlighted that one of the advantages of the outer device for universal inspection of risers (100) is the possibility to make a transpositive non-destructive inspection associated with a visual inspection.

The outer device for universal inspection of risers (100) shall not be restricted to this utilization and may be utilized in cleaning processes. Should one fit the motor-driven trestle (106) with a proper means for scraping or any other cleaning equipment, it is possible to carry out a cleaning around the whole outer surface of the production collection line (1) during the going-down course, and later on during the course of going-up and, by means of the chambers (109), (109') and (109"), to make a rapid evaluation of the quality of the operation carried out.

The invention was described herein with a referral being made to its main works to be performed. It must, however, be clear that the invention is not limited to these works, and those who have capabilities in the technique will immediately understand that alterations and substitutions could be made within the frame of this inventive concept described herein.

What is claimed is:

1. An outer device for universal inspection of risers in free catenary, said outer device comprising:

two ring-shaped underframes, namely an upper ring-shaped underframe and a lower ring-shaped underframe, each of said ring-shaped underframes having a rectangular, parallel-shaped profile, two semicircular sections connected by hinges and a means for closing, said two ring-shaped underframes being positioned spacedly apart from and parallel to one another, said upper ring-shaped underframe being fitted on an innerside thereof with a track having a "T"-shaped profile, said track being fitted with a motor-driven trestle adapted to receive and retain a plurality of non-destructive testing sensors, said lower ring-shaped underframe being fitted with two interlocks, having a semicircular shape, which constitute a speed-control device;

at least three beams, positioned equal distance apart from one another, said beams being positioned parallel to an axis of a production collection line, said at least three beams being secured to said two ring-shaped underframes to interconnect the upper and lower ring-shaped underframes and retain said underframes parallel to one another to create resistance to a main body of the outer device for universal inspection of risers, and said at least three beams being fitted with arms positioned in an orthogonal relationship to a main axis of the device, said arms being disposed in an upward orientation, such that a free end of each said arm is remotely disposed from an outer surface of the production collection line, and positioned over the upper ring-shaped underframe; the free ends of said arms being fitted with cameras having foci directed to the outer surface of the production collection line, at least three hermetic receptacles secured to said ring-shaped underframes by first supports, said hermetic receptacles being positioned spacedly equal distance apart from another, each of said hermetic receptacles having a substantially cylindrical shape and being oriented parallel to the main axis of the device said receptacles being adapted to retain a communications system, an inspection system and a movement and power system; and at least four sets of equidistantly positioned second supports, fitted with rollers, disposed on an innerside portion of the outer device.

2. The outer device for universal inspection of risers in free catenary, in accordance with claim 1, wherein the motor-driven trestle, is adapted upon being put into motion to make a translation movement by means of the track thereby making successive rotations around the main axis of the outer device for universal inspection of risers.

3. The outer device for universal inspection of risers in free catenary, in accordance with claim 1 wherein said motor-driven trestle is fitted with a tool for cleaning an outer surface of said production collection line.

4. The outer device for universal inspection of risers in free catenary, in accordance with claim 1, wherein the distance of the cameras in relation to the main axis of the device is arranged to facilitate the production of a unit panoramic image by said cameras, said outer device further including software to process images produced by said cameras to generate three-dimensional images of the outer surface of the production collection line.

5. The outer device for universal inspection of risers in free catenary, in accordance with claim 1, wherein said cameras are capable of generating normal or special images.

6. The outer device for universal inspection of risers in free catenary, in accordance with claim 1, wherein said communications system comprises a communications plate, namely a modem, capable of transmitting and receiving data by means of cables or through an acoustic sonar technology.

7. The outer device for universal inspection of risers in free catenary, in accordance with claim 1, wherein said inspection system comprises at least one type of non destructive testing equipment.

8. The outer device for universal inspection of risers in free catenary, in accordance with claim 1, wherein said inspection system comprises accelerometers and gyroscopes for vortex induced vibration measurement.

9. The outer device for universal inspection of risers in free catenary, in accordance with claim 1, wherein said movement and power system is adapted for providing autonomy and management of energy of the device, said movement and power system comprising set-up batteries for feeding of on-board pieces-of-equipment, illumination, and speed control, said movement and power system further comprising a module for facilitating a return of said device to the surface of a body of water.

10. The outer device for universal inspection of risers in free catenary, in accordance with claim 1, wherein said module for facilitating a return of said device to the surface of a body of water facilitates an emptying operation of compartments that be initially flooded with water said emptying operation being achieved by pyrolysis or an expansion of compressed gas.

11. The outer device for universal inspection of risers in free catenary, in accordance with claim 1, wherein said second supports are provided with means for adjusting said device to adapt to a multiplicity of production collection line diameters said second supports being further adapted to establish with precision an alignment of the axis of the device with the axis of the production collection line, thereby maintaining a proper pressure for a free movement of the device along an extension of the production collection line.

12. The outer device for universal inspection of risers in free catenary, in accordance with claim 1, wherein some of said rollers are fitted with remotely-driven motor traction or thrusters.

13. The outer device for universal inspection of risers in free catenary, in accordance with claim 1, wherein said speed-control device comprises at least two semicircular interlocks, for creating friction against a surface of the production collection line during an ascent or descent of said device.

* * * * *